US005471020A

United States Patent [19]

Kelsall et al.

[11] Patent Number: 5,471,020

[45] Date of Patent: Nov. 28, 1995

[54] MODAL SILENCER

[75] Inventors: John T. Kelsall, Oakville; Theodorus A. Gerritsen, Burlington, both of Canada

[73] Assignee: Hatch Associates Ltd., Mississauga, Canada

[21] Appl. No.: 112,967

[22] Filed: Aug. 30, 1993

[51] Int. Cl.[6] ..... E04F 17/04

[52] U.S. Cl. ..... 181/224; 181/296

[58] Field of Search ..... 181/224, 225, 181/226, 229, 217, 232, 262, 267

[56] References Cited

U.S. PATENT DOCUMENTS

| | | | |
|---|---|---|---|
| 1,964,845 | 7/1934 | Dietze . | |
| 3,511,336 | 5/1970 | Rink . | |
| 3,759,157 | 9/1973 | Larkfeldt et al. | 181/224 |
| 4,361,206 | 11/1982 | Tsai | 181/255 |
| 4,368,799 | 1/1983 | Wagner | 181/255 |
| 4,690,245 | 9/1987 | Gregorich et al. | 181/272 |
| 4,713,097 | 12/1987 | Grawi et al. | 181/229 |
| 5,174,113 | 12/1992 | Deville | 181/262 |
| 5,183,976 | 2/1993 | Plemons | 181/264 |
| 5,273,127 | 12/1993 | Burg | 180/116 |

*Primary Examiner*—Khanh Dang
*Attorney, Agent, or Firm*—Ridout & Maybee

[57] ABSTRACT

In order to abate unwanted noise having as its source a stack or duct of large cross-sectional dimension, a venturi is installed in the duct such as to suppress at least the highest order modes of sound propagation in the stack or duct. The invention is most useful with stacks or ducts having a cross-sectional dimension exceeding 50 cm.

4 Claims, 1 Drawing Sheet

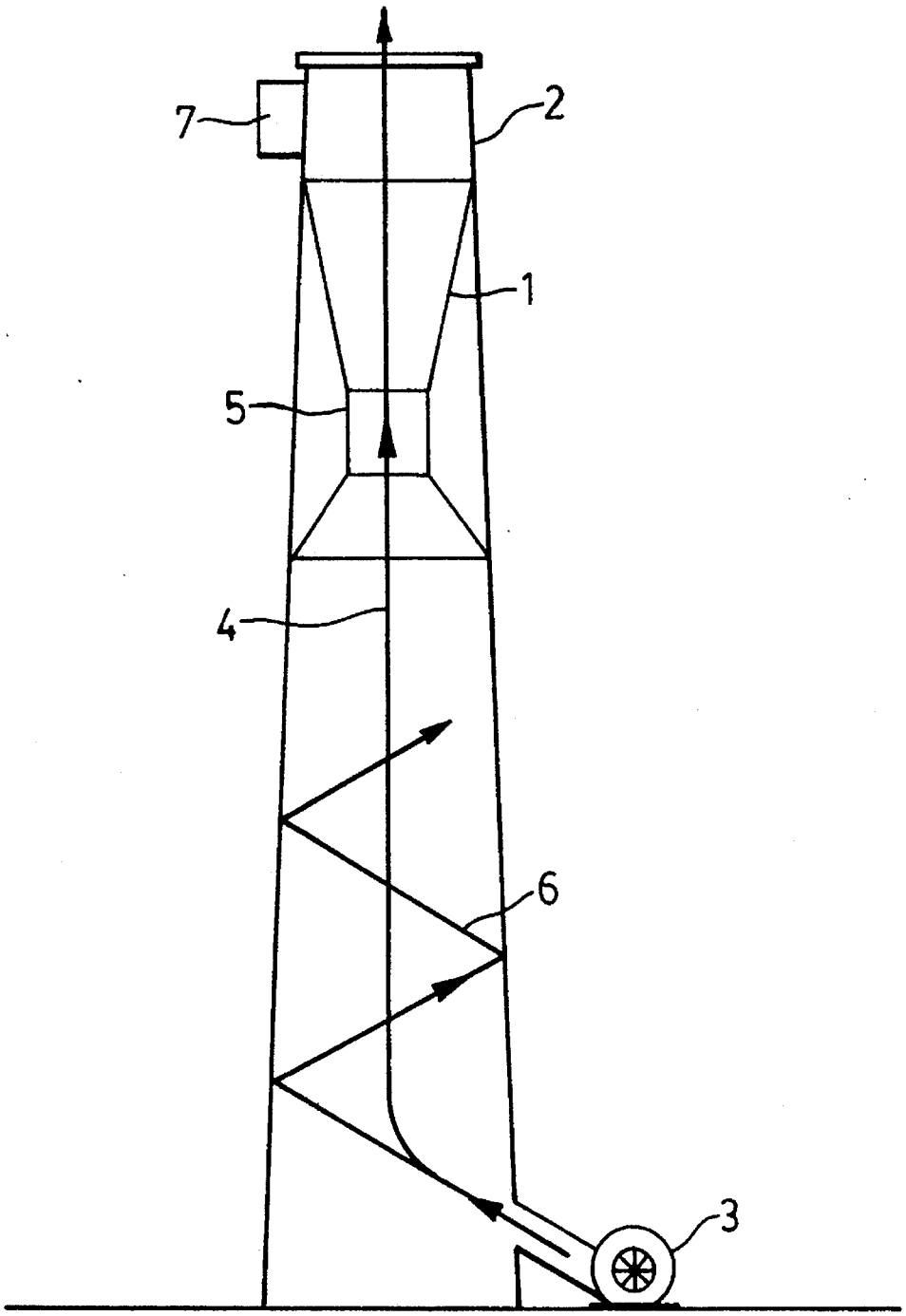
7
2
1
5
4
6
3

MODAL SILENCER

BACKGROUND OF THE INVENTION

1. Field of the Invention

This invention relates to the attenuation of sound propagating in stacks and other gas ducts of relatively large diameter.

2. Review of the Art

In industrial installations, noise problems can arise as a result of the propagation of audible sound through stacks or ducts of relatively large diameter, usually in the direction of gas flow through the duct or stack. Depending upon the origin of the sound, this can have a widely varying spectral content, although for any particular installation, this spectral content will usually remain relatively constant and may have much of its energy concentrated at specific frequencies. Whilst frequencies in the entire audible frequency range from 20 Hz to 20 kHz can represent a source of noise nuisance, the frequency range from 50 Hz to 4,000 Hz, which corresponds to the range of greatest sensitivity of the human ear, causes the majority of noise concerns.

In a stack or duct, sound frequencies above a "cut-off frequency" can propagate not only in a plane mode longitudinally of the stack or duct, but also in higher order modes characterized by repeated reflection of the sound from the walls of the duct. The number of higher order modes depends on the shape of the duct and the extent to which the frequency propagated exceeds the cut-off frequency. Such higher order propagation tends to result in greater off-axis radiation of the sound at an exit from the stack or duct, thus increasing the noise nuisance. The cut-off frequency in a cylindrical duct or stack is, in Hertz, 0.586 c/d, where c is the speed of sound in the duct or stack in meters per second and d is the diameter of the duct or stack in meters. The formula is somewhat different for ducts or stacks of non-circular cross section, but ducts or stacks having the same major cross sectional dimension will exhibit generally similar cut-off frequencies.

Accordingly, ducts or stacks with a cross sectional dimension greater than about 5 centimeters will, at room temperature in air, permit higher order propagation of sound at frequencies lower than 4,000 Hertz, although such propagation is unlikely to be significant in ducts or stacks with a cross sectional dimension less than 10 centimeters, with the problem becoming steadily worse as the duct size increases.

It has been proposed, for example in U.S. Pat. Nos. 4,361,206 (Tsai), 4,368,799 (Wagner) and 4,690,245 (Gregorich et al) to utilize venturis in mufflers for internal combustion engines used in trucks and alike, but typically the exhaust pipes utilized for such engines are of too small diameter for higher mode propagation of sound to present a significant problem, and the venturis are utilized in conjunction with other features to attenuate plane mode propagation of sound through a muffler structure. It is also known, as disclosed in U.S. Pat. No. 3,511,336 (Rink et al) to utilize a venturi provided with sound absorbing walls in a similar application. U.S. Pat. No. 1,964,845 (Dietze et al) discloses a silencing system for a ventilation duct which includes a multi-chamber acoustic filter, the chambers beings connected by tapering sections in order to obtain the smooth and rapid air flow between the chambers, although the sections lack the gradually tapering exit sections typical of conventional venturis.

It is also known to install venturis in ducts or stacks, typically as part of flow measurement or other instrumentation.

SUMMARY OF THE INVENTION

We have now found that higher mode propagation of sound in a large cross section duct or stack can be controlled by installing therein a venturi having a cross sectional dimension at the throat such as will locally substantially increase the cut-off frequency of the duct or stack in which it is installed. The energy loss entailed passing a gas flow through a well designed venturi with appropriate inlet and outlet tapers relative to the direction of gas flow can be very low even if the constriction at the throat of the venturi is quite severe. By introducing such a venturi, the cut-off frequency of a duct or stack may be substantially increased, and if the cut-off frequency of the unmodified duct or stack was such that its cut-off frequency was substantially below 4,000 Hz then a substantial suppression of higher mode propagation of frequencies below 4,000 Hz may be expected, i.e. the venturi acts as a modal silencer. It should be understood that the invention may be very beneficial even in cases where not all high order modes are suppressed, since in a wide duct and depending on the source of the noise, the highest order modes may represent a substantial proportion of the sound energy being propagated.

SHORT DESCRIPTION OF THE DRAWINGS

The invention is described further with reference to the accompanying drawing, which illustrates schematically an exemplary stack to which the invention has been applied.

DESCRIPTION OF A PREFERRED EMBODIMENT

Referring to the drawing, a stack 2 of round cross section is shown, in this case with a slight taper from bottom to top. Near the bottom of the stack is a fan 3, which is assumed to generate noise at frequencies within the 50 Hz to 4,000 Hz frequency band, and for the sake of example to generate a strong component at 250 Hz. The fan outlet enters the stack from the side, which tends to favour higher order modes of propagation within the stack, shown schematically at 6, as compared to the fundamental mode plane wave propagation 4 axially of the stack.

The installation of a venturi 1 within the stack, which has a diameter of about 4 meters, with a throat 5 having a diameter of 2.4 meters, will produce, at room temperature, substantial attenuation or modal silencing of the upper seven of the fourteen modes in which the 250 Hz component would propagate within the stack without installation of the venturi, resulting in a considerable reduction of the 250 Hz component into the neighbourhood surrounding the stack.

Although the source and spectral content of sound propagating within a duct (of which a stack is a special case) may vary widely, the installation of a venturi, which should of course be designed in accordance with good engineering practice for such devices to minimize energy losses due to pressure drop across the device as a whole and should provide a substantial constriction of the cross-sectional dimensions of the duct, into a duct having a cross-sectional dimension of at least 10 cm, and preferably at least 50 cm, will result in a substantial overall reduction of higher mode propagation of sound in the 50–4000 Hz frequency range.

The invention is particularly useful in ducts and stacks having dimensions large enough that sound at a frequency of interest can propagate in more than two modes. Although some improvement may be attainable with venturis having throats providing quite limited constriction, in practice a throat having a cross-sectional area which is less than about 80% that of the duct or flue will be appropriate, depending upon the modes it is desired to suppress. In designing the venturi, appropriate allowance must of course be made for the temperature and composition of gases within the duct or stack.

Depending on the application, it may be desirable to use the modal silencer of the invention in conjunction with an active silencer 7 in order to suppress the fundamental mode plane wave 4. The venturi is dimensioned so that its cut off frequency is below a frequency of interest, thus suppressing higher modes of propagation. The two silencers complement each other since the modal silencer does not attenuate the plane wave 4, whilst known active silencers do not operate well in the presence of higher order modes. The active silencer may be located anywhere beyond the inlet taper of the venturi: in the example shown it is located just beyond the exit flare of the venturi.

We claim:

1. A method of reducing noise nuisance due to the emission of sound at a frequency in the range of 50 Hz–4000 Hz from a gas filled duct having a cross-sectional area with a cross-sectional dimension of at least 50 cm, comprising installing in the duct a modal silencer in the form of a venturi having a throat with a cross-sectional area less than 80% of that of the duct to reduce substantially the propagation through the duct of higher order modes of sound in said frequency range.

2. The method of claim 1, further comprising using an active silencer in conjunction with the modal silencer.

3. In a gas carrying duct having a cross-sectional area with a cross-sectional dimension exceeding 50 cm and constituting a source of unwanted noise in the frequency range of 50 Hz–4000 Hz, the improvement comprising a modal silencer installed in the duct as a noise abatement device, the modal silencer being a venturi having a throat with a cross-sectional area less than 80% of that of the duct.

4. The installation of claim 3, further comprising an active silencer beyond an inlet taper of the modal silencer.

* * * * *